United States Patent [19]

Redwine

[11] Patent Number: 4,775,015

[45] Date of Patent: Oct. 4, 1988

[54] SLIDING-WEIGHT OPERATED HOLE BORING TOOL

[76] Inventor: Mickey Redwine, Rte. 3, Box 3262 B, Ben Wheeler, Tex. 75754

[21] Appl. No.: 923,227

[22] Filed: Oct. 27, 1986

[51] Int. Cl.[4] ..... B25D 9/06

[52] U.S. Cl. ..... 173/90; 175/75; 175/78; 175/58

[58] Field of Search ..... 173/90, 91, 73, 78, 173/79; 175/74, 58, 87, 256, 306

[56] References Cited

U.S. PATENT DOCUMENTS

| | | | |
|---|---|---|---|
| 604,330 | 5/1898 | Kibling . | |
| 1,252,374 | 1/1918 | Gilman | 173/73 |
| 3,820,847 | 6/1974 | Jacoby | 299/5 |
| 3,961,673 | 6/1976 | Woltens et al. | 173/32 X |
| 4,252,200 | 2/1981 | Peterson | 175/58 |
| 4,310,057 | 1/1982 | Brame | 173/91 |
| 4,433,737 | 2/1984 | Malloy | 175/5 |

*Primary Examiner*—E. R. Kazenske
*Assistant Examiner*—Willmon Fridie, Jr.
*Attorney, Agent, or Firm*—Keaty & Keaty

[57] ABSTRACT

A sliding-weight operated hole boring tool can be used to make holes of various length or depth in varied soil conditions. A uniquely-shaped tool bit helps to form a smooth, clean hole. In preferred embodiments, detachable elongated stems are used to vary the length of the tool, and water is used to aid boring in hard soil.

1 Claim, 2 Drawing Sheets

SLIDING-WEIGHT OPERATED HOLE BORING TOOL

BACKGROUND OF THE INVENTION

1. Field of the Invention

The present invention relates to sliding-weight operated tools, and more particularly to sliding-weight operated hole boring tools.

2. Background of the Invention

Sliding-weight operated tools have been around for a number of years. U.S. Pat. No. 716,274, issued in 1902, discloses one such tool, which comprises a rod having dual collars, a sliding weight disposed on the rod between the collars, and tool bits disposed on the rod on opposite ends of the rod from the collars. The tool was designed to be used to form holes in masonry, and in operation, one of the tool bits (for example, a hollow cylinder) is placed against the masonry such that the tool extends perpendicularly from the masonry. The sliding weight is then repeatedly and forcefully slid into contact with the collar adjacent the tool bit. The momentum of the weight is transferred to the tool bit at each strike of the collar by the weight, thereby causing the tool bit to penetrate the masonry and form a hole therein.

U.S. Pat. No. 3,050,095 discloses another sliding-weight operated tool, which comprises a hexagonal rod having a tear-drop shaped tool bit on one end thereof, a first collar adjacent the other end, a second collar intermediate the first collar and the tool bit, and a sliding weight disposed on the rod between the two collars. The sliding weight has two handles projecting ourtwardly therefrom, and the tool is described as being useful for boring holes in tree stumps. In operation, the sliding weight is slid upwardly and downwardly between the two collars and when it strikes the second collar, the impact is transmitted to the tool bit, which forms a hole in the tree stump.

U.S. Pat. No. 3,568,657 discloses a tool for breaking rocks, similar to the tool of Pat. No. 716,274, in which various means are provided to remove the sliding weight from the tool.

Yet another sliding-weight operated tool is described in U.S. Pat. No. 4,241,795. In that tool (a "manual jack hammer"), the sliding weight is a rod disposed within a shaft, and strikes a tool bit, a portion of which is elastically retained in the lower end of the shaft.

While it appears that these tools would function well in carrying out the jobs for which they were intended, they are inherently limited by their structure as to the length or depth of holes which they are capable of boring. Also, they would not function well in certain soil conditions.

SUMMARY OF THE INVENTION

The device of the present invention is a sliding-weight operated boring tool which is preferably variable in length to allow holes of various length or depth to be formed therewith. The device preferably has means to facilitate boring in tough soil conditions.

The sliding-weight operated boring tool has a tool drive means adjacent one end thereof, and a tool bit adjacent the other end. The tool drive means serves to provide a driving force to enable the tool bit to form a hole, and comprises a shaft and a sliding weight, the shaft having means to limit relative movement between the shaft and the sliding weight. The means to vary the length of the tool preferably comprises elongated stems with means to quickly and easily connect the stems intermediate the tool drive means and the tool bit.

A hole may be begun with a tool bit directly connected to the tool drive means. The sliding weight is reciprocated on the shaft, and each strike of the movement-limiting means by the sliding weight imparts momentum to the tool bit, lengthening the hole. Elongated stems are periodically added to the tool to enable the tool to bore a hole having the desired length or depth.

If the soil is particularly hard to bore through, it may be desirable to use a pressurized fluid, such as water, to aid in the boring of the hole. In such a case, means are provided to connect a source of fluid to the tool, and means are provided to allow the fluid to pass through the tool, and exit via one or more fluid ports in the tool bit.

The tool bit is preferably shaped such that it forms a hole having compacted walls as it penetrates the ground, and also compacts, against the walls of the hole as the tool bit is removed therefrom, dirt which may fall into the hole.

It is an object of the present invention to provide a variable length sliding-weight operated boring tool.

It is a further object of the present invention to provide a sliding-weight operated boring tool having means to quickly and easily vary the length thereof.

Another object of the present invention is to provide a sliding-weight operated boring tool having means to allow a fluid to pass therethrough.

Yet another object of the present invention is to provide a variable-length sliding-weight operated boring tool which has means to allow a fluid to pass therethrough.

It is also an object of the present invention to provide a sliding-weight operated boring tool having a tool bit comprising means to form a bore having compacted walls, and means to compact dirt against the wall of a bore when the tool is retrieved from a bore.

BRIEF DESCRIPTION OF THE DRAWINGS

For a further understanding of the nature, objects and advantages of the present invention, references should be had to the following detailed description, taken in conjunction with the accompanying drawings, in which like parts are given like reference numerals, and wherein.

DETAILED DESCRIPTION OF THE PREFERRED EMBODIMENT

Figure 1:
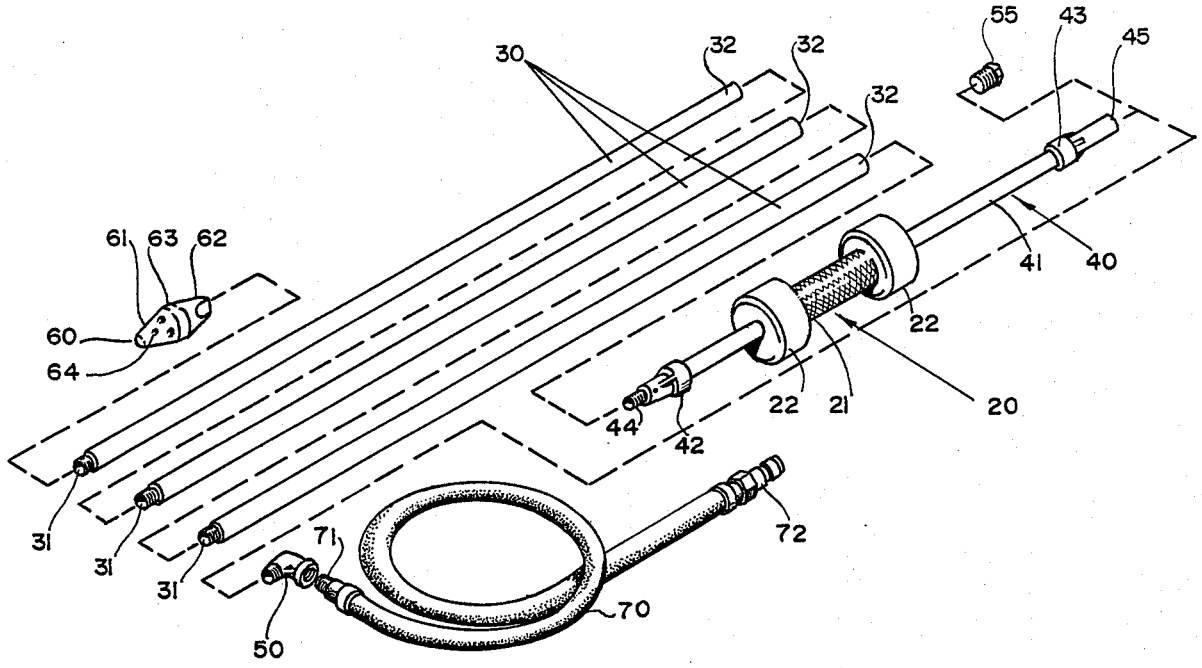
FIG. 1 is a perspective view of component parts of the preferred embodiment of the device of the present invention.

The preferred embodiment of the device of the present invention is a sliding-weight operated hole boring tool 10, component parts of which are illustrated in FIG. 1. Tool 10 includes a tool drive means 40 comprising a hollow shaft 41 having collars 42, 43 disposed adjacent ends thereof, and a sliding weight 20 carried on shaft 41 between collars 42 and 43. Collars 42 and 43 serve to limit movement of sliding weight 20 relative to shaft 41. A first end 44 of shaft 41 has male threads thereon for receiving a female-threaded end 32 of an elongated bore stem 30, and a second end 45 of shaft 41 is provided with female threads for receiving either a male threaded plug 55 or an elbow hose coupling 50, depending on whether the soil conditions permit dry boring or require wet boring.

Sliding weight 20 comprises a sleeve 21, adapted to be easily gripped by one's hand, and two weight collars 22 disposed adjacent opposite ends thereof. Each bore stem 30 has, in addition to female-threaded end 32, a male-threaded end 31 for receiving either another bore stem 30, or a tool bit 60. Tool bit 60 comprises two generally frustoconical portions 61 and 62 on opposite ends of a cylindrical portion 63. A plurality of water ports 64 are provided in front frustoconical portion 61 of tool bit 60, to permit water to be ejected into the bore when wet boring is necessary. A heavy duty supply hose 70 has a male-threaded end 71 for attachment to elbow 50, and a quick-connect coupling 72 on the other end for connection to a suitable source of pressurized fluid, such as a water hose.

Threaded connectors are the preferred means for connecting tool bit 60, bore stems 30 and tool drive means 40, as they provide a relatively strong, fluid-tight connection and enable assembly and disassembly of tool 10 to be performed relatively quickly and easily.

Shaft 41, sleeve 21 and bore stems 30 are made of a suitably strong material, such as steel. Weight collars 22 and tool bit 60 are preferably made of steel.

Figure 3:
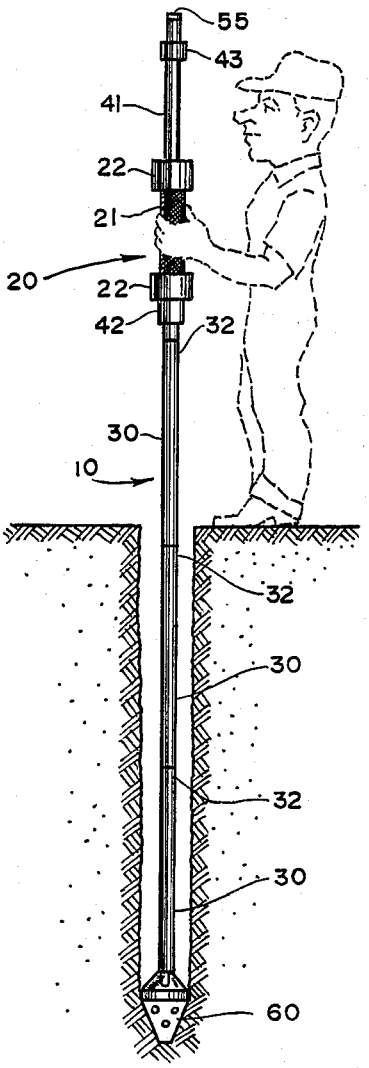
FIG. 3 is a perspective view of the preferred embodiment of the present invention being used to dry bore a vertical hole.
Figure 4:
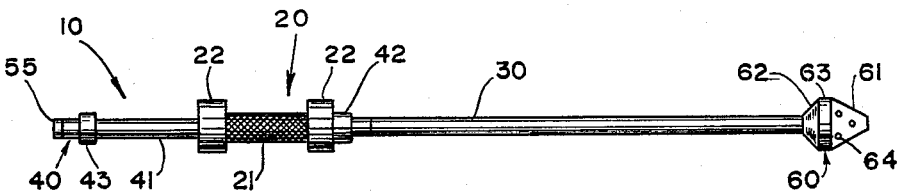
FIG. 4 is a perspective view of the device of the preferred embodiment of the present invention assembled for dry boring.

When dry boring, plug 55 is screwed into female-threaded end 45 of shaft 41, a female-threaded end 32 of a bore stem 30 is screwed onto male-threaded end 44 of shaft 41, and tool bit 60 is screwed onto male-threaded end 31 of bore stem 30 (FIG. 4). If boring a vertical hole (FIG. 3), tool 10 is vertically positioned with front frustoconical portion 61 on the ground at the spot where the hole is to be bored. Sliding weight 20 is slid up and down on shaft 41 and, with each downward slide, forcefully contacts collar 42. Momentum is transferred from sliding weight 20 to tool bit 60 via bore stem 30. As tool bit 60 is pounded into the ground, front frustoconical portion 61 forces soil to the sides of the bore, forming a bore with compacted walls. When the bore is so deep that end 44 of shaft 41 is adjacent the surface of the ground, tool drive means 40 is disconnected from bore stem 30, a second bore stem is connected to the first bore stem, and tool drive means 40 is connected to the second bore stem. Tool bit 60 is again pounded into the ground by means of sliding weight 20, and more bore stems are added as needed to achieve a bore having the desired depth. Tool bit 60 is designed to penetrate such things as brick and broken concrete, so one must take care to locate any existing utilities, as tool bit 60 may also cut through metal pipes and cables. Once the desired depth has been reached, tool 10 is pulled from the bore, either in one piece or in sections. Any dirt that may fall or have fallen into the bore is compacted against the wall of the bore, by back frustoconical portion 62 of tool bit 60 during retrieval of tool 10. Should any resistance to the removal of tool 10 be encountered, sliding weight 20 may be used to strike collar 43 to facilitate the removal of tool 10.

When dry boring a horizontal hole, the procedure is essentially the same. Tool 10 is aligned coaxially with the longitudinal axis of the desired bore, and sliding weight 20 is slid back and forth on shaft 41, transferring momentum to tool bit 60 when sliding weight 20 forcefully contacts collar 42 on each forward slide.

Figure 2:
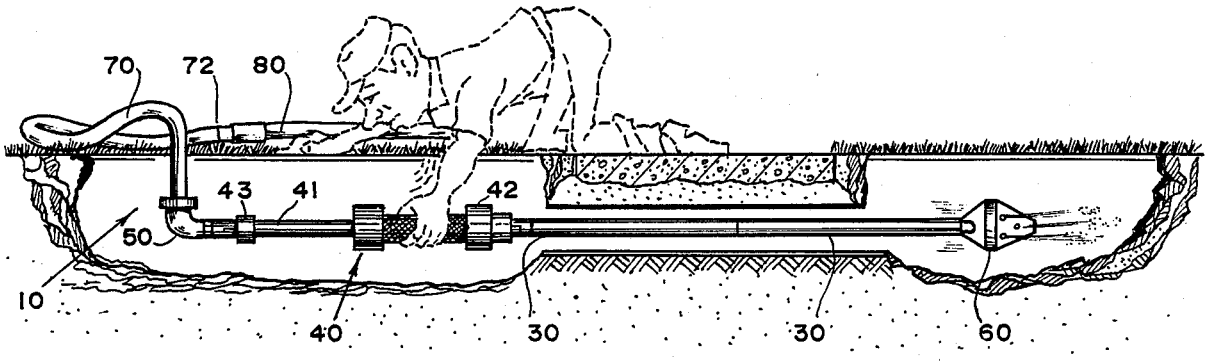
FIG. 2 is a perspective view of the preferred embodiment of the device of the present invention being used to wet bore a horizontal hole.
Figure 5:
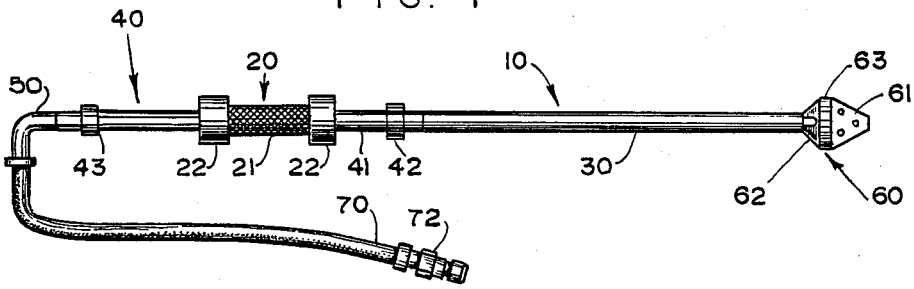
FIG. 5 is a perspective view of the preferred embodiment of the present invention assembled for wet boring.

When wet boring, plug 55 is replaced with elbow hose coupling 50 and heavy duty hose 70 (FIG. 5). A garden hose 80 (shown in FIG. 2) is connected to heavy duty hose 70, providing a source of pressurized water for tool 10. The water flows through shaft 41, bore stems 30, and exits tool 10 via fluid ports 64 in tool bit 60. With the water flowing through tool 10, sliding weight 20 is slid back and forth or up and down (depending on whether a horizontal or vertical hole is being bored) until end 44 of shaft 41 is adjacent an end of the hole. A faucet supplying water to garden hose 80 is shut off and/or garden hose 80 is disconnected from heavy duty hose 70 (preferably, quick-connect coupling 72 is of a type that no water flows out of garden hose 80 when it is disconnected from heavy duty hose 70), and another bore stem 30 is added to tool 10. Garden hose 80 (if it had been disconnected) is then connected again to tool 10, and boring of the hose resumes. When the hole is completed (FIG. 2), garden hose 80 is again disconnected from tool 10, and tool 10 is pulled out of the hole, in one piece if space permits, or is disassembled as it is removed.

It should be noted that the sliding weight could comprise a rod which would fit in a shaft, with a handle at an end of the rod. Also, a more massive sliding weight than would be practical for use in horizontal boring could be used when boring a vertical hole, in which case the sliding weight could comprise handles to facilitate lifting of the sliding weight. These and other modifications could be made to the preferred embodiment shown and described herein, without departing from the spirit or scope of the present invention. I therefore pray that my rights to the present invention be limited only by the following claims.

I claim:

1. A sliding-weight operated tool, said tool comprising:

a tool drive means comprising a shaft and a sliding weight, said shaft comprising means to limit movement of said sliding weight relative to said shaft;

a tool bit disposed adjacent an end of said tool, said tool bit having means to form a bore having compacted walls, said means comprising a first frustoconical portion having a base, said tool bit further comprising means for compacting dirt against the walls of a bore when said tool is retrieved from a bore, said means comprising a second frustoconical portion having a base, the base of the first frustoconical portion being parallel to the base of the second frustoconical portion; and means to vary the length of the tool, said means comprising a plurality of elongated stems and means for connecting the elongated stems intermediate said tool drive means and said tool bit.

* * * * *